US005405196A

United States Patent [19]

Shoup et al.

[11] Patent Number: 5,405,196

[45] Date of Patent: Apr. 11, 1995

[54] ADJUSTABLE SHELF PERSONAL CARE CABINET

[75] Inventors: Curtis C. Shoup, El Toro; Victor A. Stalley, Thousand Oaks; Kenneth P. Mendoza, Hermosa Beach, all of Calif.

[73] Assignee: Jensen Industries, Inc., Los Angeles, Calif.

[21] Appl. No.: 35,056

[22] Filed: Mar. 22, 1993

[51] Int. Cl.[6] ..... A47B 88/00

[52] U.S. Cl. ..... 312/351; 248/488; 312/350

[58] Field of Search ..... 312/351, 408, 352, 227, 312/242, 128, 238; 248/488; 211/87, 89, 90; 108/102, 105, 107; 62/263

[56] References Cited

U.S. PATENT DOCUMENTS

| | | | |
|---|---|---|---|
| 673,712 | 5/1901 | Harper . | |
| 2,553,965 | 5/1951 | Gist | 312/242 |
| 3,067,882 | 12/1962 | Ribbens et al. | 211/136 |
| 3,266,858 | 8/1966 | Klotz | 312/270 |
| 4,101,105 | 7/1978 | DiCenzo | 248/158 |
| 4,856,746 | 9/1989 | Whobel et al. | 248/250 |
| 5,139,322 | 9/1992 | Aisley | 312/350 |

FOREIGN PATENT DOCUMENTS

| | | | |
|---|---|---|---|
| 434805 | 9/1935 | United Kingdom | 211/81 |

*Primary Examiner*—Peter A. Aschenbrenner
*Assistant Examiner*—Nancy Mulcare
*Attorney, Agent, or Firm*—Harlan P. Huebner

[57] ABSTRACT

An adjustable shelf personal care cabinet that employs a plurality of snap-in support rods that are removably mounted in the rear wall of the cabinet wherein the rods are structured to receive the edge of a shelf with the opposite edge received in a side wall of the cabinet or another support rod. The support rods are bifurcated at one end for contaction and entry into the rear wall to snap-in and remain until removed.

14 Claims, 4 Drawing Sheets

ADJUSTABLE SHELF PERSONAL CARE CABINET

BACKGROUND OF THE INVENTION

1. Field of the Invention

This invention relates to a personal care cabinet, such as found in a bathroom that is built in and employs a plurality of snap-in shelf support rods so as to modify and adjust the vertical spaces between shelves and the lengths of shelves.

2. Description of the Prior Art

In prior art cabinets with adjustable shelves there are a number of opposite grooves on side walls and the shelf stretches across the opening and slides into the grooves. Such a construction is found in U.S. Pat. No. 4,904,032.

Another prior art cabinet has inward projections or lances forming a number of shelf receiving ledges such as found in U.S. Pat. No. 1,307,949.

In addition there are interchangeable shelf support brackets that are disclosed in U.S. Pat. No. 4,856,746.

All of the above have the disadvantage of requiring the use of full shelves that extend across the cabinet and thus there is no provision for tall bottles unless the entire width of the cabinet is left open. This can be a waste of space.

U.S. Pat. No. 5,139,322 has to some extent solved the problem by employing vertical central supports so that half shelves may be used. This also has its disadvantages as walls are formed at the central portion of the cabinet which close off usable space. In addition with the vertical supports they are in increments to receive only at the most three shelves and the spacing is not nearly as versatile as needed. This structure has limited applications.

SUMMARY OF THE INVENTION

It is the purpose of the present invention to provide a personal care cabinet that employs snap-in shelf support rods that may be releasably positioned in the back wall of a cabinet to receive a half shelf on one or both sides of the support rod.

Another object of the present invention is to provide a support rod that is a snap-in support that has a bifurcated end adapted to be squeezed together to insert within any of a series of vertically arranged rod receiving openings in a rear wall of the cabinet and releasing the bifurcated ends to return to a position wherein the support rod is releaseably locked into the opening.

A still further object of the present invention is to provide a snap-in shelf support rod that includes a groove on each side to receive the end of a half shelf one on either side to make a complete shelf thereacross or just a half shelf.

Another object of the present invention is to provide a snap-in support rod with a shelf receiving groove on one side only.

A yet further object of the present invention is to provide a cabinet that has no shelf receiving grooves or ledges on the back wall but only a plurality of vertically spaced receiving openings to receive the snap-in support rods.

Another object of the present invention is to provide caps to close up the vertically spaced openings on the backwall that are not being used to create a clean cosmetic cabinet back wall.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

Figures 2, 3, 4, 5, 5A:
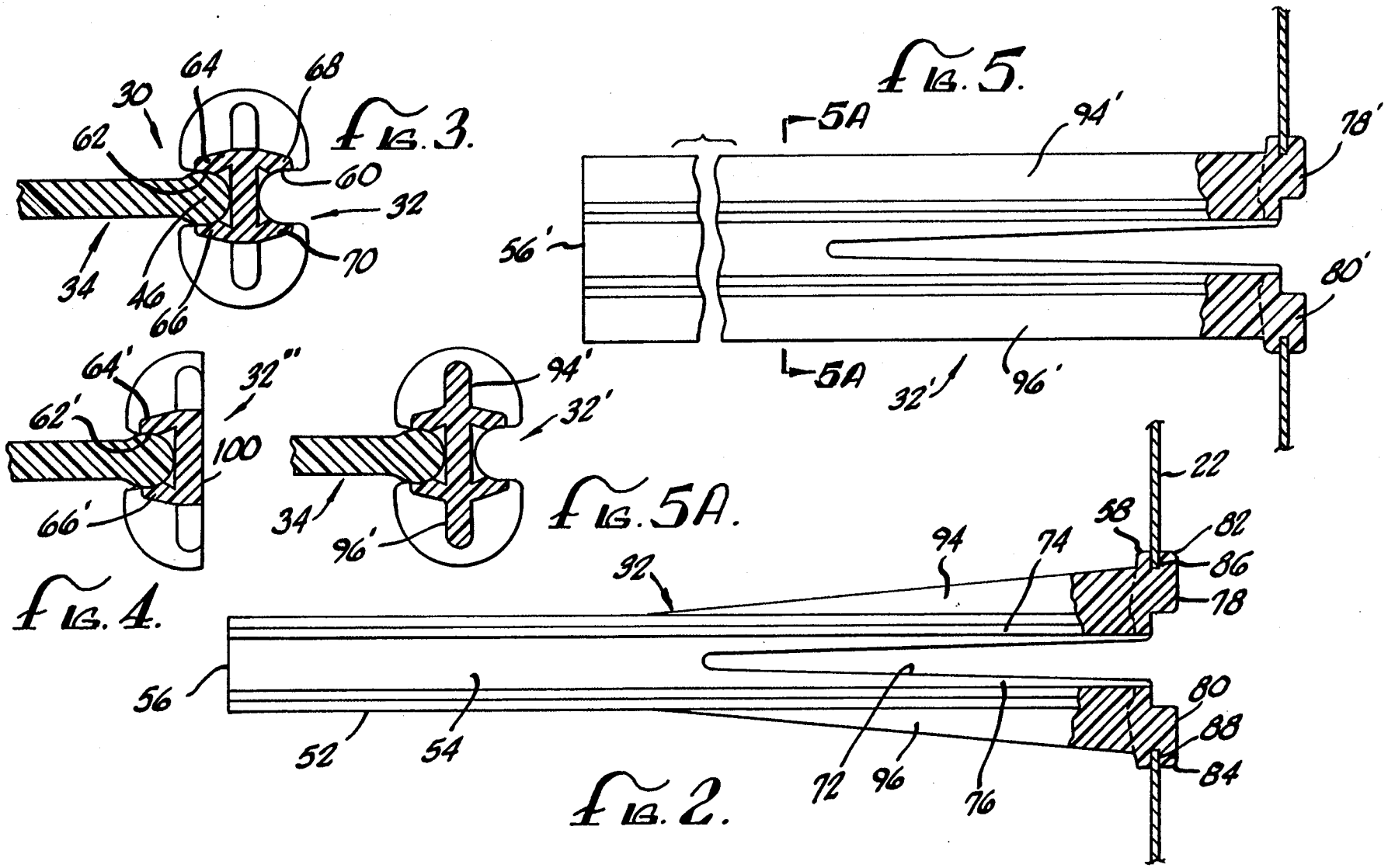
FIG. 2 is a side elevational view partially in cross-section of one of the snap-in support rods taken on line 2—2 of FIG. 1.
FIG. 3 is a cross-sectional view of a snap-in support rod and a shelf therein taken on line 3—3 of FIG. 1.
FIG. 4 is a cross-section of a modified snap-in support rod, taken on line 4—4 of FIG. 1.
FIG. 5 is a side elevational view of a modified snap-in support rod.
Figure 6:
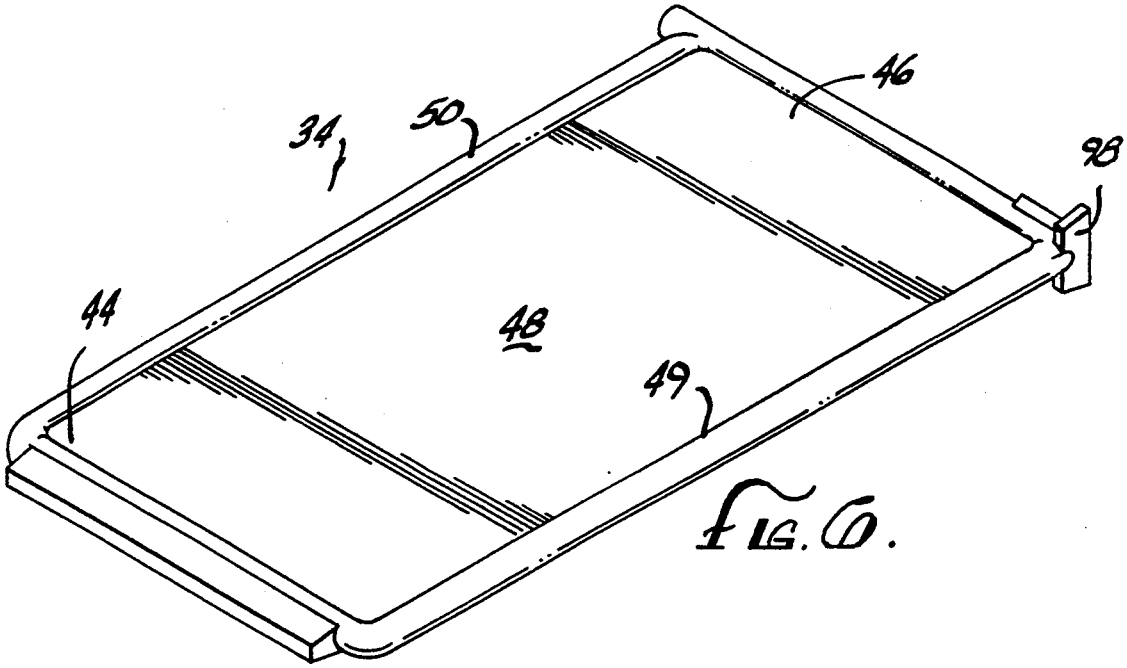
Figure 8:
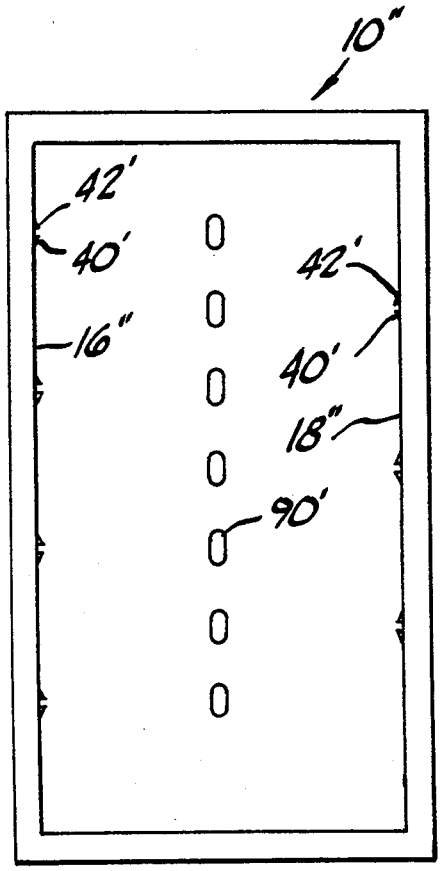
Figure 9:
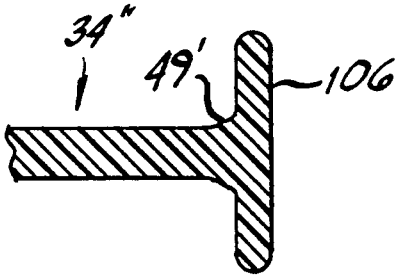
Figure 7:
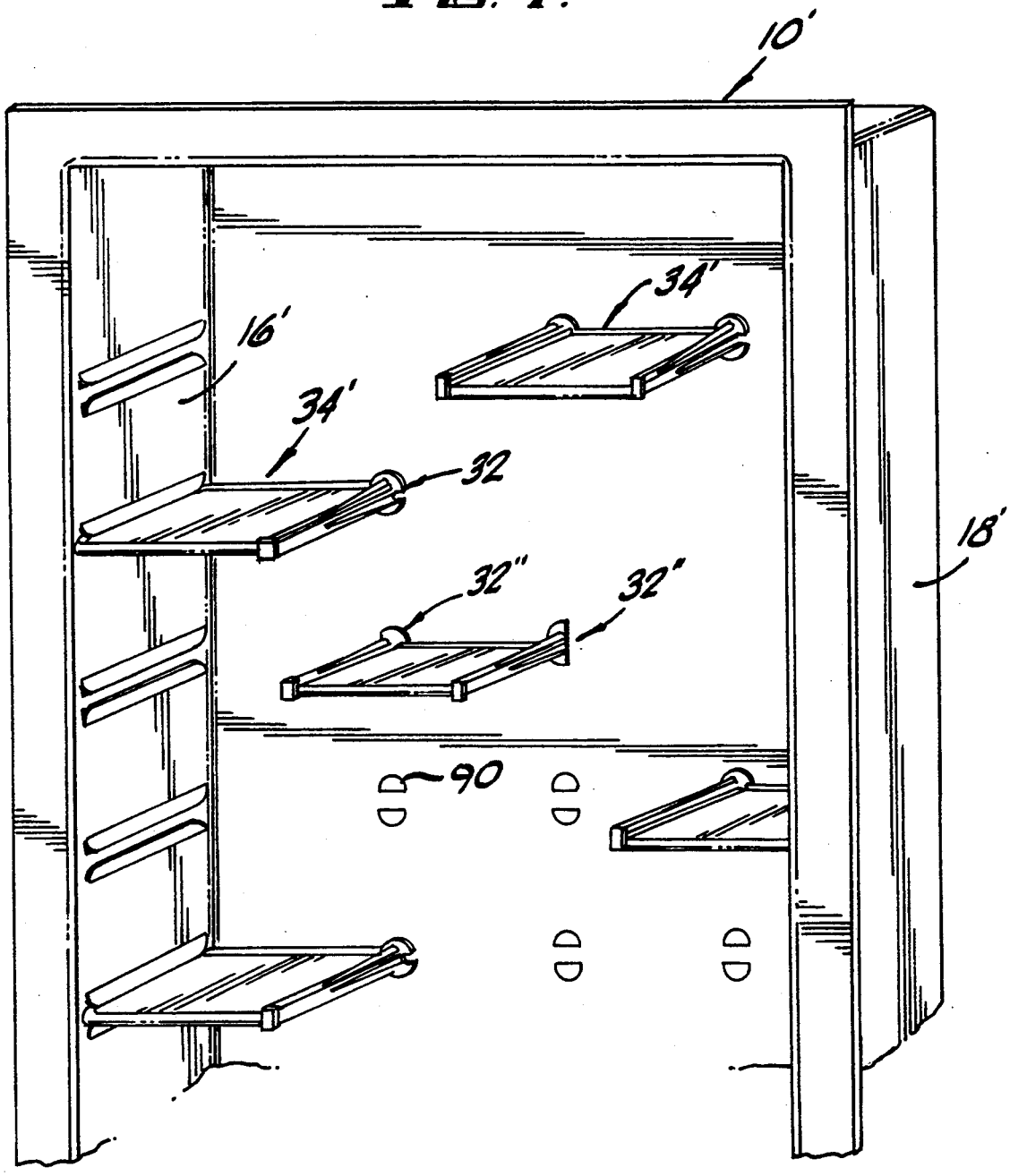

FIG. **5*a* is an end view of the rod taken on line 5*a*—5*a* of FIG. 5**;

FIG. 6 is a perspective view of a shelf member with a decorative half end for a snap-in support rod;

FIG. 7 is a partial perspective view of a modified personal care cabinet wherein there are a plurality of vertical rows of mounting holes in the back wall of the cabinet;

FIG. 8 is another modified cabinet structure with single rod receiving holes and staggered shelf lances; and FIG. 9 is a partial cross section of the front edge of a modified shelf with frontal stop means.

DETAILED DESCRIPTION OF THE PREFERRED EMBODIMENT

Figure 1:
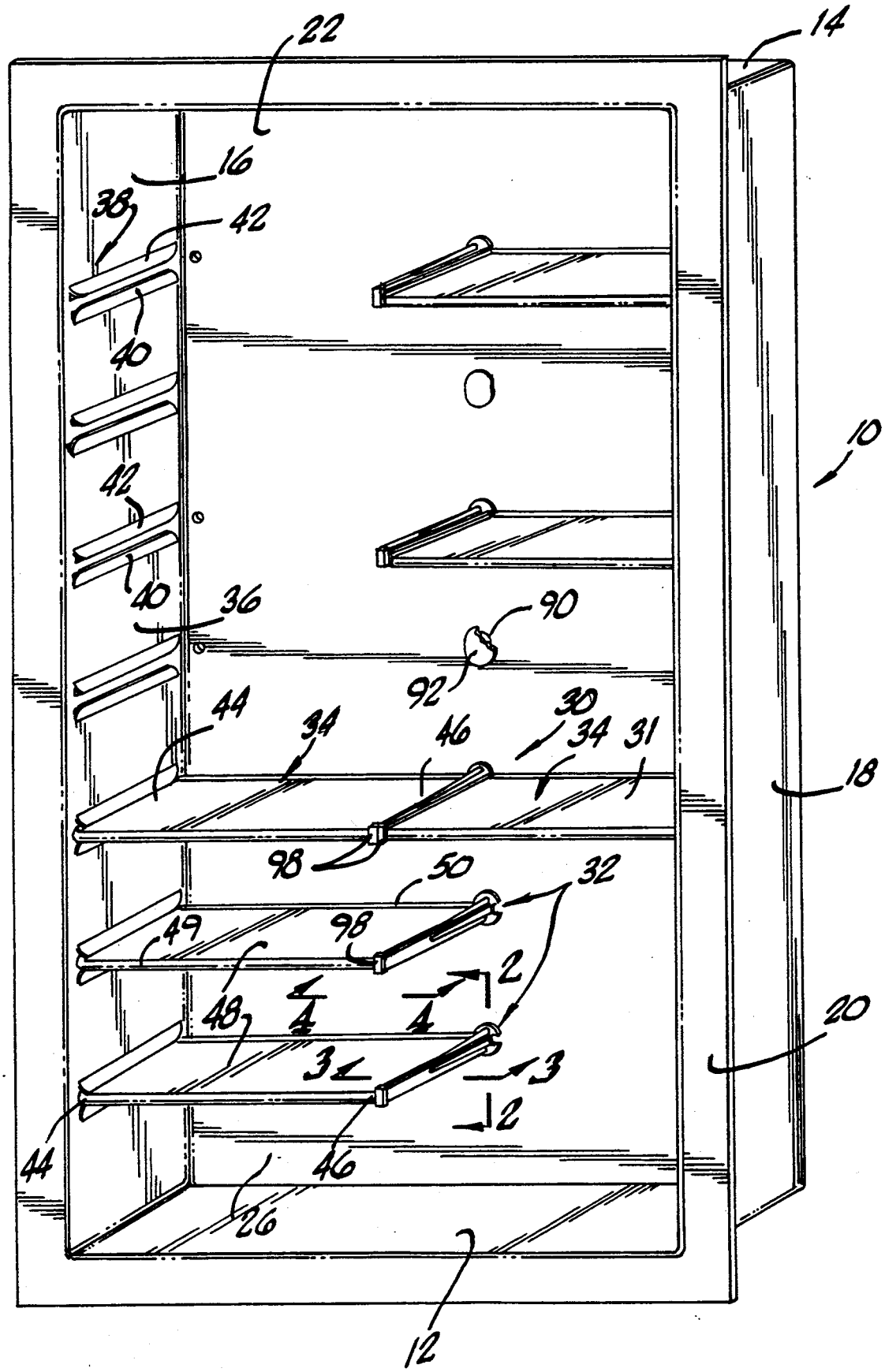
FIG. 1 is a perspective view of a personal care or bathroom type cabinet with the inventive snap-in support rods and half shelves in position.

In FIG. 1 there is illustrated a built-in cabinet generally designated 10. The cabinet 10 is preferably of a one piece plastic or metal construction. However, if it is made of wood or partical board various pieces may be fabricated and fitted together. The cabinet 10 includes a bottom and a top wall 12 and 14 and a pair of parallel side walls 16 and 18 forming the cabinet. Projecting radially outwardly from the front of the walls is a cosmetic flange 20 that extends around the walls so as to hide any gaps between the cabinet 10 when it is inset within a cut out of a building wall and the wall itself. A back wall 22 extends between the side walls, top and bottom walls. Again however, the cabinet 10 may be mounted directly on a wall and not recessed therein. In that case the flange 20 may be eliminated.

While not shown a hinged door construction is usually provided to close off the interior space 26. The door construction may have a mirror on the outside.

The present invention resides within the cabinet 10 and is directed to adjustable snap-in shelf support means 30 and shelf structure means 31.

The snap-in support means 30 each includes a plurality of snap-in shelf support rods designated 32, see particularly FIGS. 2, 3 and 4. The plurality of shelf structure means 31 are half shelves designated 34 that are preferably formed of transparent plastic or clear glass.

The interior surface 36 of side wall 16 and the interior wall (not seen) of side wall 18 are each provided with space apart shelf retainers designated 38. In the present embodiment there is a lower support arm or lance 40 struck from the wall 16 and an upper support armor lance 42 formed with a space therebetween sufficient to slidably receive an end 44 of half shelf 34. While support lances are struck from the walls 16 and 18 a slot could be cut into surface 36 of wall 16 to receive the end 44 or shelves 34 to accomplish the same purpose.

The half shelf 34 includes an end 44 and an opposite end 46 and a flat surface 48 for receiving medicines and other personal care items and preferably is of a width corresponding to the depth of the cabinet 10 as set by the depth of the walls members 12, 14, 16 and 18.

Preferably the ends 44 and 46 and edges 49 and 50 of the shelves 34 are rounded (see FIG. 3) and beaded to assure a proper fit within the groove and between the lances 40 and 42. Also the bead on the front edge 48 will to some extent act as a stop.

The shelves 34 are each approximately half the length across the cabinet 10 from wall 16 to wall 18. However, in a modification to be discussed the shelves 34 may be of a lesser length.

As for the shelf support lances 40 and 42 there are a plurality of them vertically spaced in the walls 14 and 16 to allow for the adjustability of height and spacing of the shelves 34 within the cabinet 10.

In the modified cabinet 10'' illustrated in FIG. 8 the lances 40' and 42' may be staggered on the walls 16'' and 18'' to receive a shelf 34.

Turning now to the snap-in shelf support rod means 32, FIGS. 1, 2 and 3 best illustrate the means. There is an elongated shelf receiving rod 52 that in the preferred embodiment includes a center vertical wall section 54 extending from an exterior end 56 the entire length to interior end 58. Projecting on either side of the central wall section 54 are shelf receiving recesses 60 and 62 forming by spaced apart projecting elongated flanges 64 and 66 and 68 and 70 respectively.

As best seen in FIG. 2, the shelf support rod 32 is bifurcated inward for a distance from end 58 with a tapered cut off 72 made in the rod. Projecting from the end 58 of each section 74 and 76 of the bifurcation are end plate sections 78 and 80. At the top 82 of section 78 and the bottom 84 of section 80 locking slots 86 and 88 are formed.

For mounting the rod supports 32, the back wall 22 is provided with a member of vertically spaced openings 90 which each may be a pair of arcuate vertically aligned openings such as seen in FIG. 7 in the cabinet 10' or single openings 90' as seen in FIG. 8 in the cabinet 10''.

For cosmetic purposes snap-in caps 92 may be provided to cover the unused openings 90.

In order to add strength to the rod supports 32 a pair of tapered gussets 94 and 96 may be provided. The gussets each taper from near the respective top 82 and bottom 84 downward approximately half the length of the supports 32 to the flanges 64 and 66 and 68 and 70 respectively.

If it is desired to achieve greater strength in the rod supports 32' as shown in FIGS. 5 and 5*a*, the gussets 94' and 96' may each be of a common width and extend the entire length from the end plate section 78' and 80' to the end 56' of the rod 32'.

To mount a support rod or rods 32 the sections 74 and 76 are pinched together so the end plate sections 78 and 80 will fit into the single or double opening 90 or 90' in the rear wall 22 and then released. As the sections 78 and 80 want to return to their original set they will spread apart and snap into the slots 86 and 88 to secure the support rods 32 in place.

Once the rod or rods are positioned where desired a shelf 34 is positioned within the recess 60 or 62 and opposed lances or grooves 40 and 42 on the side walls.

Also while not essential the shelf 34 may at one end be fitted with a cosmetic cap 98 which will abut one half of the end 56 of the support rod 32 when the shelf 34 is completely inserted. If a second half shelf 34 is to be mounted on the opposite side of the rod 32 then shelf 34 is turned over for insertion and the cosmetic cap 98 abuts the other cap and the other half of the end 56 of the support rod 32.

In some cases where only a half shelf is to be used on one side, the support rod 32'' may also be constructed as seen in FIG. 4 with only one flange pairs 64' and 66' with one recess 62'. The side wall 100 is preferably smooth.

FIG. 7 illustrates another embodiment of the cabinet 10' wherein instead of one row of support rod receiving openings 90 there may be two or three. With such an arrangement small shelves 34' may be used to extend between the side walls 16' and 18' and a support rod 32 or two support rods 32''.

Finally, in FIG. 9 there is illustrated a modified shelf 34'' with a front bead 49' and a vertical front stop wall 106 that extends above and below the shelf so that one shelf can be reversed for insertion and still have the stop to prevent items on the shelf 34'' from falling off.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. We do not wish to be restricted to the specific forms shown or uses mentioned, except as defined in the accompanying claims, wherein various portions have been separated for clarity of reading and not for emphasis.

We claim:

1. An adjustable shelf personal care cabinet having a pair of spaced apart vertical side walls, top and bottom spaced apart walls between said side walls and a rear wall encompassing the area defined by said side walls, top and bottom walls comprising:

a plurality of vertically spaced shelf receiving means on said side walls;

at least one shelf having a pair of opposed ends and of a width less than the width between said side walls of said cabinet and of a thickness less than said width;

at least one vertical row of a plurality of openings in said rear wall spaced between said side walls and each opening corresponding in horizontal alignment with a shelf receiving means on one of said side walls;

at least one snap-in shelf support rod means releasable mountable in one of said openings and projecting outwardly from said rear wall, and having an elongated core section of a vertical dimension slightly greater than the thickness of said shelf and having two sides and a shelf receiving recess extending along at least one side of said core section on an horizontal plane to maintain one end of said shelf and the other end of said shelf adapted to be received in said vertically spaced shelf receiving means on said side wall or within another snap-in shelf support rod depending on the selected adjustment and position, said elongated core section including an outer end and inner end, said core section at said inner end being bifurcated into two sections, said bifurcations extending inwardly toward said outer end and being resiliently flexible, each bifurcated section at the inner end including end plate sections and locking means; and said bifurcated sections being depressible toward each other forming a reduced combined end plate section with said end plate sections being fitted through one of said openings in said back wall, and upon release of said sections said locking means engaging and retaining said support rod means to said rear wall with said core section cantilevered outwardly of said rear wall.

2. An adjustable shelf personal care cabinet as defined in claim 1 wherein:

said locking means includes an opposing groove in each end plate section; said grooves each being of a width to engage and receive therein the end wall adjacent said opening and locking the section therein.

3. An adjustable shelf personal care cabinet as defined in claim 1 wherein:

said core section of said support rod includes:

at least one strengthening gusset projecting from one of said end plates along said core section.

4. An adjustable shelf personal care cabinet as defined in claim 3 wherein:

there are two gussets, one on opposite sides of said core section.

5. An adjustable shelf personal care cabinet as defined in claim 1 wherein:

there is a shelf receiving recess on each side of said core section.

6. An adjustable shelf personal care cabinet as defined in claim 1 wherein:

said shelf has an annular bead there around extending above and below said shelf and said bead on said opposed ends interfits within said shelf receiving means and said spaced shelf receiving means on one of said side walls.

7. An adjustable shelf personal care cabinet as defined in claim 6 wherein:

said shelf includes a rear edge and a front edge, and said front edge included a lip extending above said shelf as well as below said shelf, said lip acting as a stop means.

8. An adjustable shelf personal care cabinet as defined in claim 6 wherein:

said shelf includes a rear edge and a front edge, and one of said opposite ends includes an elongated projection which is shorter than the distance between said rear and front edge adapted for interfitting into said vertically spaced shelf receiving means on said side wall.

9. An adjustable shelf personal care cabinet as defined in claim 8 wherein:

said vertically spaced shelf receiving means each includes a pair of vertically spaced apart lances struck outwardly from said side walls creating a space there between and said lances adapted to accommodate said elongated projection.

10. An adjustable shelf personal care cabinet as defined in claim 1 wherein:

there is one row of openings equidistance said side walls; and said shelf is generally a half width shelf that is interfitted within said vertically spaced shelf receiving means on said side wall and said shelf receiving means in said snap-in shelf support rod means.

11. An adjustable shelf personal care cabinet as defined in claim 1 wherein:

there are at least two rows of openings in said back wall;

said shelf is generally the width of the distance between said rows of openings or one of said rows of openings and a side wall.

12. An adjustable shelf personal care cabinet as defined in claim 11 wherein:

there are at least two snap-in shelf support rod means each mounted in openings in adjacent rows of openings in horizontal alignment; and said shelf is suspended between said support rod means and forms a shelf to receive items that are less than half the distance between said side walls.

13. In an adjustable shelf personal cabinet having a pair of spaced apart vertical side walls, top and bottom spaced apart walls between said side walls all of a common depth, a rear wall encompassing the area defined by said side walls and including a series of vertically spaced openings, top and bottom walls, a plurality of less than full width shelves for mounting in said cabinet at positions as desired, said shelves each having opposed ends, shelf support lances struck from each of said side walls and vertically spaced one from the other for selectively mounting said shelves in said cabinet, the improvement including:

a plurality of bifurcated snap-in shelf support rods adapted to be selectively mounted within said vertically spaced openings in said rear wall, each of said support rods including an elongated core section of a vertical thickness slightly greater than the thickness of said shelves, a shelf receiving recess extending along at least one side of each of said core sections on a horizontal plane and end of each of a shelf adapted to be mounted in said shelf receiving recess and the other end adapted to be mounted in one of said shelf support lances.

14. In an adjustable shelf personal cabinet defined in claim 13 wherein:

each of said bifurcated snap-in shelf support rods include opposed shelf receiving recesses wherein a shelf may be mounted on either side of said rod and wherein said support rod may receive a pair of shelves on a common horizontal plane extending across said cabinet between said side walls.

* * * * *